United States Patent [19]

Schmoeger

[11] Patent Number: 4,882,992

[45] Date of Patent: Nov. 28, 1989

[54] COMBINATION POWDER APPLYING AND/OR INFRARED DRYING ATTACHMENT FOR PRINTING PRESSES

[75] Inventor: Duane A. Schmoeger, Raleigh, N.C.

[73] Assignee: Airtech Company, Inc., Cary, N.C.

[21] Appl. No.: 344,809

[22] Filed: Apr. 28, 1989

Related U.S. Application Data

[63] Continuation of Ser. No. 225,802, Jul. 29, 1988, abandoned.

[51] Int. Cl.[4] ..... B41F 35/00

[52] U.S. Cl. ..... 101/424.1; 101/424.2; 34/4; 34/41; 118/642

[58] Field of Search ..... 101/424.1, 424.2, 419; 118/45, 46, 642; 34/4, 9, 19, 41

[56] References Cited

U.S. PATENT DOCUMENTS

| | | | |
|---|---|---|---|
| 2,941,062 | 6/1960 | Halley | 219/39 |
| 3,078,587 | 2/1963 | Huck | 34/48 |
| 3,745,307 | 7/1973 | Peek, Jr. | 34/4 |
| 3,829,982 | 8/1974 | Pray et al. | 34/4 |
| 3,861,351 | 9/1975 | Bonwit et al. | 101/424.1 |
| 4,408,400 | 10/1983 | Pinto | 101/424.1 |
| 4,716,658 | 1/1988 | Jacobi, Jr. | 101/424.1 |
| 4,773,167 | 9/1988 | Jacobi, Jr. | 34/4 |

FOREIGN PATENT DOCUMENTS

| | | | |
|---|---|---|---|
| 0044369 | 1/1982 | European Pat. Off. | 101/424.1 |
| 2412493 | 10/1974 | Fed. Rep. of Germany | 101/424.1 |
| 2637875 | 3/1978 | Fed. Rep. of Germany | 101/424.1 |

OTHER PUBLICATIONS

"New Inks Boost Use of Infrared Dryers on Sheet Fed Offset Presses" Inland Printer/American Lithographer 6/78, pp. 49–50.

*Primary Examiner*—Eugene H. Eickholt

*Attorney, Agent, or Firm*—Bell, Seltzer, Park & Gibson

[57] ABSTRACT

The attachment is selectively usable to apply heat, anti-offset powder, or both heat and powder to freshly printed sheets passing to the sheet collection station of a printing press. Operation of the heat and/or powder applying assemblies is changed automatically to compensate for changes in the press speed. The location at which heat is applied to the sheets is upstream from that at which powder is applied, and is spaced from the collection station. Shields and air currents assist in regulating heat transfer. A compact housing assembly supports both heat and powder applying components.

20 Claims, 4 Drawing Sheets

COMBINATION POWDER APPLYING AND/OR INFRARED DRYING ATTACHMENT FOR PRINTING PRESSES

This application is a continuation of application Ser. No. 225,802, filed July 29, 1988, now abandoned.

FIELD OF THE INVENTION

This invention relates to the means employed in smaller size printing presses for preventing ink transfer or "offset" between freshly printed sheets transported to the stacking or other sheet collecting station of a printing press. The invention more particularly relates to an improved anti-offset means having selectively operable radiant heating means and sheet spraying means.

BACKGROUND OF THE INVENTION

It is common during offset printing to provide some means for preventing ink transfer from one sheet to another during stacking of the sheets following printing of them. In smaller size printing presses, such means customarily consists of a spray assembly that sprays the sheets passing to the collection station with an anti-offset material such as an inert powder. The powder spaces adjacent sheets from each other as they are stacked at the collection station. Electrical control means may be provided for causing the spray assembly to operate cyclically such that the anti-offset material is dispensed only when it will impact upon a freshly printed sheet, and not at those times when it would pass between successive ones of the sheets moving along the path of travel to the collection station. This minimizes the amount of anti-offset material used during operation of the press, which is desirable both from the viewpoint of lessening the amount of material that must be purchased, and also from the viewpoint of reducing the time that must be devoted to vacuuming or otherwise cleaning surplus material from the press.

In larger size presses, and more recently in some of the smaller ones, infrared or other sheet heating assemblies are used to dry the ink upon the freshly printed sheets, and to thus prevent or at least lessen ink transfer between them at the collection station. Vendors and other proponents of the sheet heating assemblies stress that, unlike the powder spraying assemblies, they do not require periodic refilling and press vacuuming or similar cleaning. On the other hand, proponents of the spraying assemblies point out that the heating assemblies require substantial amounts of power and have the potential for creating fires. Due to these mutually exclusive viewpoints, and also due in part to the limited amount of space available in smaller offset printing presses for mounting an anti-offset assembly of any type, presses possessing an assembly of either of the aforesaid types customarily have not also had an assembly of the other type. However, in different situations the prevention of ink offset may be best achieved by applying heat to the freshly printed sheets, or by applying powder to them, or by applying both heat and powder. By way of illustration in the latter regard, the application of both limited heat and limited powder to the sheets might be desirable when the prevention of ink offset by the use of heat alone would require excessive power, or operation of the press at an undesirably slow speed.

SUMMARY OF THE INVENTION

With the foregoing in mind, the present invention provides anti-offset attachment means that is of a highly compact construction and that includes sheet spraying means and sheet heating means which are selectively operable either singly or in combination to prevent ink transfer between the printed sheets collected at the sheet collection station of a printing press. The anti-offset means includes radiant heating means for directing radiant energy onto the freshly printed surfaces of the sheets at a location along their path of travel spaced in an upstream direction from the sheet collection station, and also includes sheet spraying means for spraying anti-offset material upon the sheets at a location along their path of travel downstream from the first-mentioned location. The anti-offset means further includes selector switch means usable by a press operator for enabling operation of either desired one or both of the heating means and spraying means.

In the preferred embodiment of the invention, components of the sheet spraying means and the sheet heating means are mounted upon a common support assembly and are so interconnected and located relative th each other that elements of the spraying means shield elements of the heating means. Control means detects changes in the speed of press operation and automatically effects compensatory changes in the operation of the heating means and of the spraying means. More specifically, the control means decreases the radiant output of the heating means and increases the duration of each cycle of operation of the spraying means in response to decreases in the speed of the press, and the control means increases the output of the heating means and decreases the duration of each operating cycle of the spraying means in response to increases in press speed.

DESCRIPTION OF THE PRIOR ART

Powder dispensing attachments for printing presses are disclosed in U.S. Pat. No. 4,332,198 and West German Offenlegungsschrift 2,637,875. The attachment of the U.S. patent is cyclically operable. The German reference discloses varying the operation of a powder dispensing attachment in accordance with changes in the speed of a printing press.

Heating devices for printing presses and other machines through which pass sheets or webs are disclosed in U.S. Pat. Nos. 4,501,072, 4,449,453, 4,434,562, 4,188,731, 4,143,278, 4,033,263, 3,960,081, 3,421,228, 3,275,196, 3,085,143, 3,078,587, 2,941,062; and in UK 2,073,390. The UK reference includes means for stopping operation of the heating means if the speed of the material being heated is below a preselected minimum speed.

Also of possible interest are the following articles: Hartsuch NEW METHODS SPEED INK DRYING, published in the February 1976 edition of Graphic Arts Monthly; and Crouser THE HEAT IS ON, published in the February 1987 edition of Quick Printing.

BRIEF DESCRIPTION OF THE DRAWINGS

Other features of the invention will be apparent from the following description of an illustrative embodiment thereof, which should be read in conjunction with the accompanying drawings in which.

DESCRIPTION OF THE ILLUSTRATED EMBODIMENT

Figure 1:
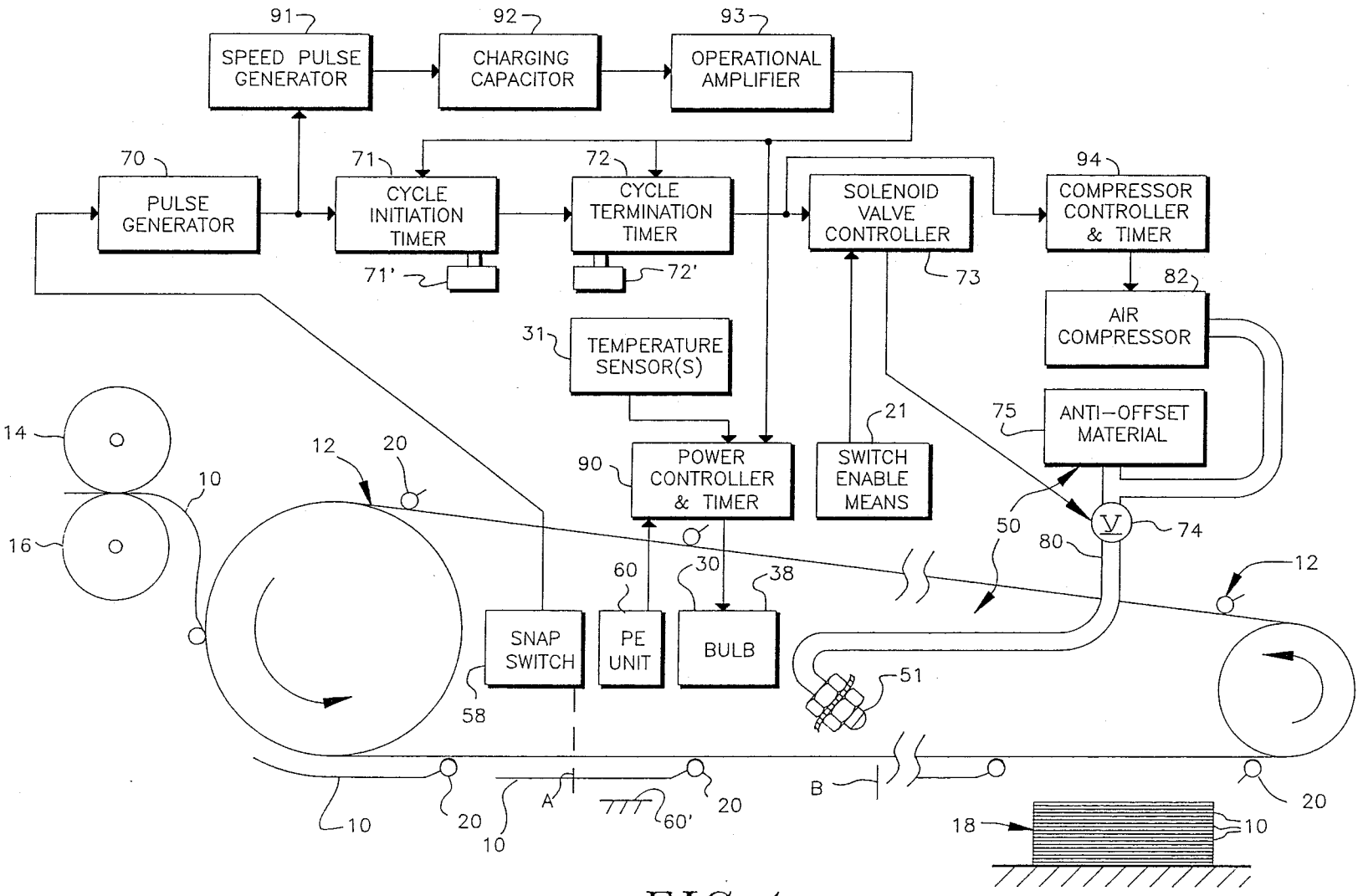
FIG. 1 is a diagrammatic and schematic representation of control and other components of anti-offset means in accordance with the invention, some associated components of a printing press also being schematically shown.

The numeral 10 in FIG. 1 designates freshly printed sheets being conveyed by the sheet delivery mechanism 12 of a printing press from its printing station, schematically represented by blanket and impression rolls 14, 16, to its sheet stacking or collection station 18. Sheet delivery mechanism is illustratively of a known endless-chain type having spaced gripper bars 20 that grasp the leading edge portions of successive ones of the sheets 10 passing from rolls 14, 16 and that release such sheets at stacking station 18. However, sheet delivery means of some other type might be employed in lieu of that shown.

To prevent ink transfer or "offset" from occurring between the freshly printed sheets at stacking station 18, anti-offset means are provided above and intermediate the length of the sheet path of travel from the printing station to the sheet collection station of the printing press. The anti-offset means includes both sheet heating means 30 and sheet spraying means 50, either one or both of which can be selectively enabled or "turned on" by appropriate operator actuations of switch means 21. Heating means 30 preferably and illustratively is of an electrically powered type which during operation radiates infrared heat from an elongate bulb member 38. Spraying means 50 preferably and illustratively is of the type which during operation sprays inert powder from nozzles 51 (only one of which is shown in FIG. 1) upon the freshly printed surfaces of each sheet 10 during passage thereof to collection station 18. As is well known to those skilled in the art, the powder separates adjacent sheets 10 from each other in the sheet stack formed at the collection station.

The anti-offset means of the invention further includes various control and ancillary components diagrammatically illustrated in FIG. 1. These include a sensor 58 for directly or indirectly detecting and signalling the presence of the leading edge of each successive one of the traveling sheets 10 at some preselected location along the path of sheet travel. While the aforesaid location might be anywhere along the sheet path of travel, it illustratively is adjacent the upstream (in relation to the direction of sheet travel) end of sheet delivery mechanism 12. In the illustrated embodiment thereof, sensor 58 consists of a snap switch engageable with a leading edge of each sheet 10 and/or with some component of sheet delivery mechanism 12 movable in unison therewith. When a sheet is detected by it, sensor 58 transmits an electrical trigger signal to a pulse generator 70 forming part of the control means for heating means 30 and sheet spraying means 50. In response to the electrical trigger signals transmitted to it from sensor 58, pulse generator 70 generates two sets of synchronous electrical pulses. One set of pulses generated by the pulse generator 70 is transmitted to electronic timers 71, 72, the output of which is received by a valve controller 73 that controls the operation of a valve 74 whose opening and closing respectively initiates and terminates each successive cycle of operation of sprayng means 50. Valve 74 is located within and controls the flow through a conduit 80 that connects spray nozzles 51 with a source 75 of anti-offset powder and with an air compressor 82 or similar source of compressed air. Air entrained anti-offset powder; from hopper 75 is received by and sprayed from nozzles 51 whenever valve 74 is open and compressor 82 is operating. A compressor controller 94, which also receives the output of timers 71, 72, maintains compressor 82 in operation as long as printed sheets 10 are passing beneath spray nozzles 51.

Potentiometers 71', 72' respectively associated with timers 71, 72 permit manual adjustment of the timing periods thereof. The duration of the timing period of timer 71 determines the delay that transpires between sheet detection by sensor 58 and commencement of a spray cycle of operation of spraying means 50. This delay compensates for the time required for the leading edge portion of each sheet 10 to travel from the indicated location A, at which sensor 58 detects the presence of the sheet, to the location B at which powder sprayed from nozzles 51 will impinge upon the freshly printed surface of the sheet. Manual adjustment of the delay time period of timer 71 by means of potentiometer 71' usually is required only when the anti-offset means is initially installed upon the printing press. The timing period of the other timer 72 regulates the time of termination, and thus the duration, of each cycle of powder spraying operation. Potentiometer 72' is used to manually and compensatingly adjust the aforesaid timing period and spray cycle duration when there is a change in the actual length of the sheets 10 being printed or, if it is desired to spray the anti-offset powder upon only a part of each of the sheets, a change in the "effective" length of the sheets.

The cycles of powder-spraying operation of spraying means 50 would no longer be properly synchronized with the movement of sheets 10 beneath nozzles 51 if the press speed were changed and there were no compensating change in the time delay periods of timers 71, 72. To avoid this highly undesirable result, means are provided for automatically adjusting the time periods of timers 71, 72 in response to, and in a manner compensating for, changes in the press speed. The aforesaid speed compensating control means includes a speed pulse generator 91 that receives a second set of the pulses that are generated by pulse generator 70 in response to the trigger signals from sheet sensor 58. In response to its receipt from generator 70 of the aforesaid pulse signals, whose frequency is proportional to the pulse speed, pulse generator 91 generates and transmits fixed length electrical pulses of the same frequency to integrator means in the form of charging capacitor 92 and an operational amplifier 93. After a brief period of time, such pulses charge the capacitor to a voltage that is proportional to the pulse frequency and therefore to the press speed. The capacitor charge constitutes an input to operational amplifier 93, which in response thereto transmits an inversely proportional control voltage signal to timers 71, 72. Such control signal does not alter the time periods of the timers as long as the press speed remains constant. In the event of a change in press speed, however, the control signal effects compensating change in the time periods of both timers. Thus, if the press speed should be doubled, the time periods of timers 71, 72 would each be halved. Similarly, if the press speed should be halved, the time periods of the timers would automatically be doubled.

The output signal from operational amplifier 93 is also received by the power controller 90 for the infrared bulb 38 of sheet heating means 30. At those times when heating means 30 is in operation, the foregoing input to controller 90 causes the same to automatically vary the preselected "standard" energy input to, and thus the radiant heat output of, bulb 38 in a manner automatically compensating for changes in the press speed. If for instance the press speed should be halved, the heat output of bulb 38 would also be halved, and if the press speed should be doubled the heat output of the bulb would also be doubled. Controller 90 also receives input from a photoelectric sensaor 60, and one or more temperature sensors 31 that are located in desired areas of the anti-offset means and/or the printing press. When the input from one of the sensors 31 indicates that the temperatures at its location has exceeded a preselected maximum, controller 90 interrupts or at least reduces the power supply to bulb 38 until the sensed temperature has returned to a safe magnitude. Photoelectric sensor unit 60 scans the portion of the paper path of travel immediately adjacent infrared bulb 38. It sends a signal to controller 90 if one of the sheets 10 should dwell beneath infrared bulb 38 for an excessive period of time, as might for instance occur if it should be prematurely released by its gripper bar 20. Upon receipt of a signal from sensor 60, controller 90 discontinues the power to bulb 90. The inputs to power controller 90 from sensors 31, 60 and operational amplifier 93 thus assist in preventing such overheating of sheets 10 and/or components of the printing press or anti-offset means as might cause damage to them or create a fire hazard.

Figure 2:
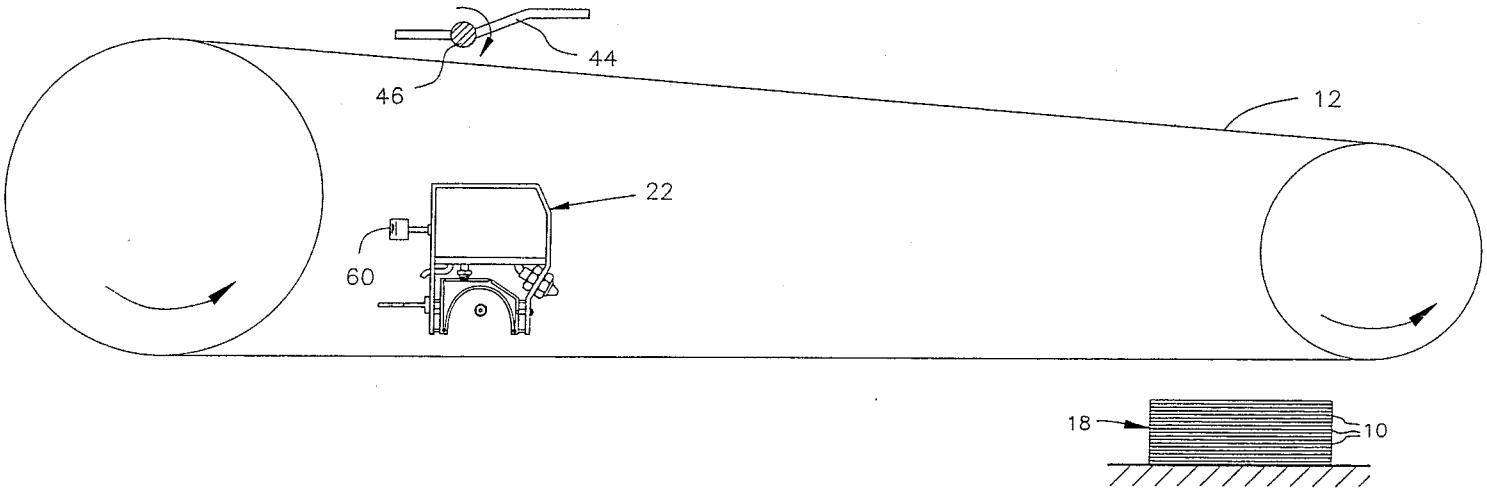
FIG. 2 is a sifde elevational view of a support assembly and therewith associated components of the anti-offset means that are located adjacent the schematically illustrated sheet delivery means of the printing press.
Figure 3:
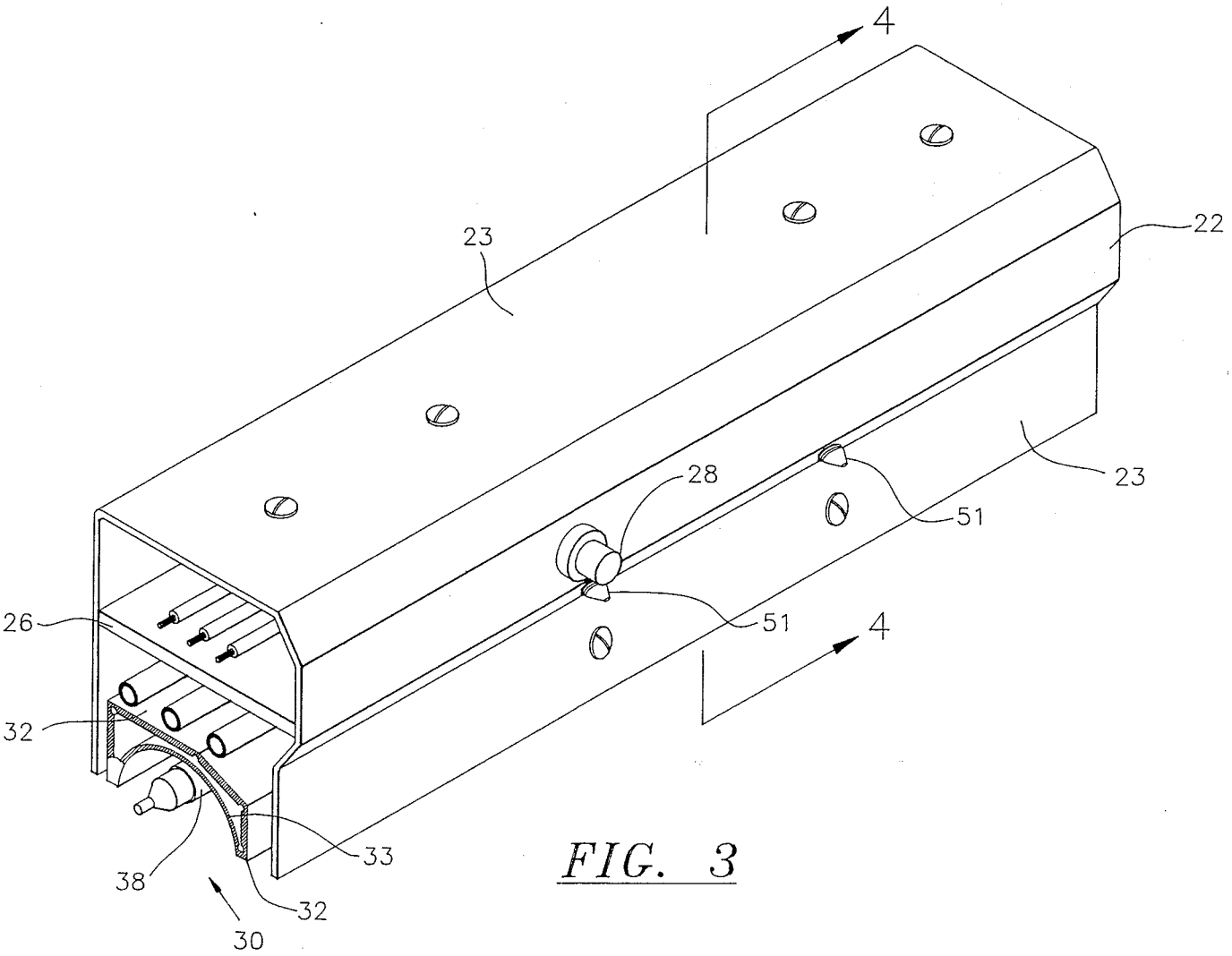
FIG. 3 is an enlarged perspective view of the support assembly of FIG. 2, part of an end wall thereof being partially broken away.
Figure 4:
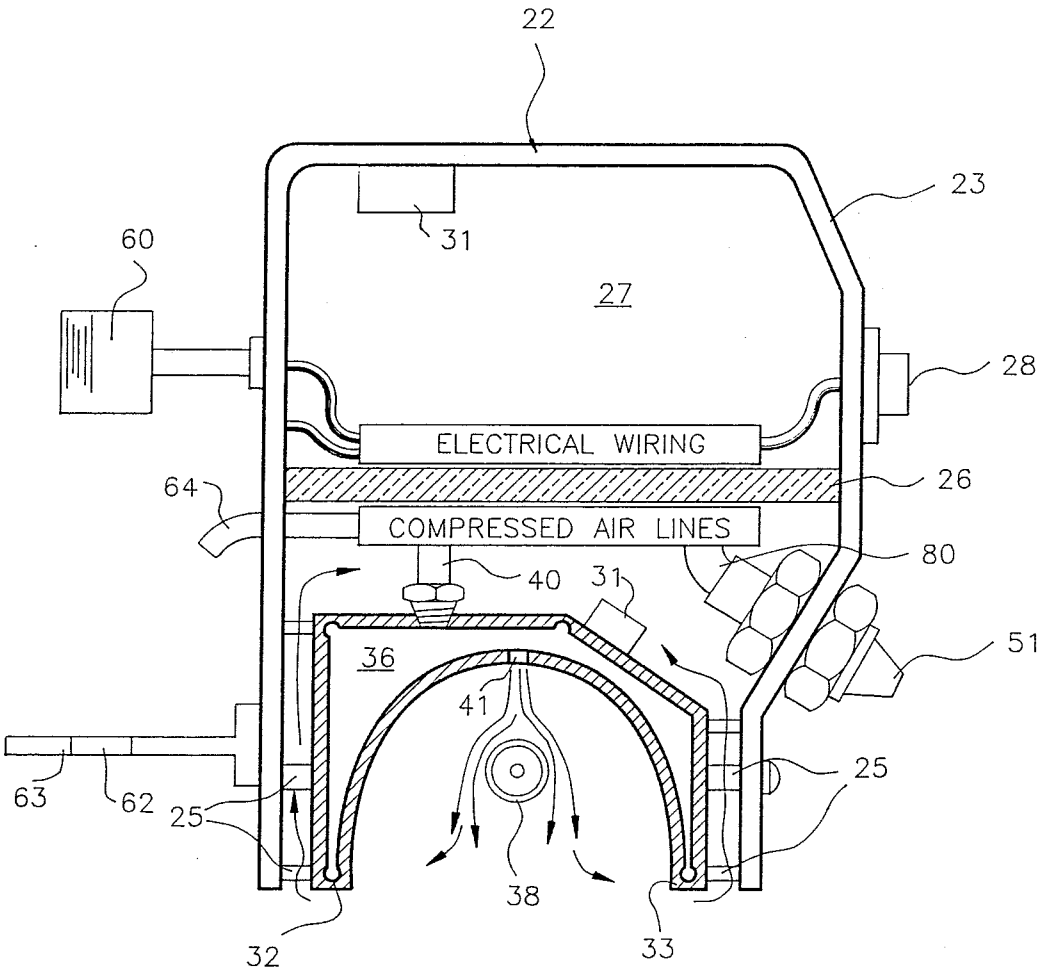
FIG. 4 is an enlarged view, primarily in vertical section taken substantially along the line 4—4 of FIG. 3, of the support assembly.

Referring now also to FIGS. 2–4 of the drawings, the anti-offset means includes an elongate support assembly 22 that is mounted in a suitable manner upon the frame of the printing press at a location above the path of travel of sheets 10 from printing rolls 14, 16 to collection station 18. Assembly 22 extends transversely of the direction of the aforesaid path of sheet travel, and is spaced in an "upstream" direction from collection station 18 and the stack of sheets 10 formed thereat. Assembly 22 includes an upper and outer housing member 23 that forms part of powder spraying means 50 and that is open at its bottom and its opposite ends. Downwardly and rearwardly inclined nozzles 51 of powder spraying means 50 are mounted upon the rear or "downstream" wall of housing 23. Also mounted upon the aforesaid wall of outer housing 23 is an indicator light 28 that is illuminated when nozzles 51 are actually spraying powder. Light 28 facilitates manual adjustment by the press operator of the duration of the cycles of operation of the powder spraying means. Sheet-detecting photoelectric unit 60 is mounted upon the front or "upstream" wall of housing 23 in vertical alignment with an aperture 62 of a heat shield 63 that is also mounted upon the same wall of housing 23. Aperture 62 permits passage of a light beam between sensor 60 and an associated reflector 60', shown in FIG. 1 and located below the path of sheet travel, at those time intervals when the light beam is not interrupted by one of the sheets 10. Shield 63 reduces the amount of heat that might pass upwardly to sensor 60, by reflection or convection, during operation of heating means 30. To further assist in preventing hot air from passing upwardly through aperture 62 to unit 60, compressed air is directed downwardly into the aperture from a conduit 64 projecting from the rear wall of housing 23.

An interior wall 26, which is formed of heat-insulting material, defines a chamber 27 within the upper portion of housing 23. Chamber 27 receives electrical wiring associated with photoelectric unit 60, indicator light 28 and other electrical components of the anti-offset means. As is indicated in FIG. 4, one of the previously-mentioned temperature safety switches 31 also may be disposed within chamber 27. Another temperature responsive switch 31 may be located within the portion of housing 23 beneath wall 26.

A lower, inner housing 32, which forms part of heating means 30, is mounted within the lower portion of upper housing 23 by means of "stand-off" connectors 25 that permit free flow of ambient air along the exterior surfaces of housing 32. Housing 32 includes an arcuate wall 33, of substantially parabolic cross-sectional configuration, having a reflective concave surface that faces downwardly toward the path of travel of the sheets 10 passing to collection station 18. Infrared heating bulb 38 is mounted in spaced adjacent relation to the aforesaid concave surface such that radiant heat eminating from the bulb will pass downwardly to the sheet either directly or by reflection from the concave surface of wall 33. A chamber 36, defined within housing 32 between its outer wall and its arcuate inner wall 33, receives compressed air from air compressor 82 (FIG. 1) via a compressed air line and a conduit 40 disposed within that part of housing 23 below partition wall 26. The aforesaid compressed air line also provides compressed air to the previously-mentioned conduit 64 that directs air into aperture 62 of shield 63. The terminal portion of the conduit 80 that conducts compressed air and anti-offset material to nozzles 51 is also located within the same area of housing 23. A plurality of vertical ports 41, only one of which is shown in FIG. 4, extend through the upper portion of arcuate wall 33 of lower housing 32 at spaced locations along the length thereof. The compressed air introduced into housing chamber 36 passes downwardly therefrom through the ports 41 of wall 33 to assist in preventing lower housing 32 from becoming unduly hot during operation of bulb 38. Additional cooling of the housing 32 is realized by the previously-noted flow of ambient air about its exterior surfaces.

The downward flow of air from housing 32 also reduces the possibility of the housing being contacted by sheets 10 in the event of a paper-jam within the press. Additionally, impingement of the air flow upon the sheets 10 passing through the pass during normal operation thereof assists in drying the ink thereon.

Support assembly 22 is normally overlaid, as indicated in FIG. 2, by a shield 44 that is mounted for pivotal movement about the axis of a suitable support 46. In its illustrated position shield 44 extends generally horizontally and minimizes heat transfer from assembly 22 to the ink-supplying fountain rolls (not shown) and other press components located thereabove. It also prevents downward passage of cleaning fluids or similar substances onto support assembly 22. By pivoting shield 44 in a clockwise direction, it may be readily displaced to an upstanding position permitting ready access to the ink-supplying fountain rolls (not shown) for purposes of inspection, repair or the like.

Depending upon the particular type of paper, ink and other conditions involved, it may be desirable during a press run to use only powder spraying means 50, or only the sheet heating means 30, or to use both the spraying means and the heating means. The particular type of means employed can be readily selected by the press operator's appropriate actuation of selector switch 21. It will be noted that when the heating means and the sheet spraying means are both utilized, the heat generated by bulb 38 is applied to sheets 10 prior to application of the powder from nozzles 51. This is highly desirable since it conserves energy that otherwise would be wasted upon heating the powder, rather than the ink upon the sheets.

The location of radiant heating bulb 38 in spaced "upstream" relationship to sheet collection station 18, in conjunction with the transverse orientation of such bulb in relation to the path of sheet travel, is desirable in that it helps ensure that the stack of sheets 10 at the collection station is not directly exposed to the heat radiated from the bulb.

While a preferred embodiment of the invention has been shown and described, this was for purposes of illustration only, and not for purposes of limitation, the scope of the invention being in accordance with the following claims.

I claim:

1. In combination with a printing press having a frame, sheet delivery means carried by said frame for conducting freshly printed sheets along a path of travel from a printing station to a sheet collection station, and anti-offset means for preventing ink offset between the sheets during collection thereof; the improvement in said anti-offset means comprising;

radiant heating means for, during operation thereof, directing radiant heat energy onto the sheets at a location along said path of travel spaced in an upstream direction from said collection station;

sheet spraying means disposed closely adjacent said radiant heating means for, during operation thereof, spraying anti-offset material upon the sheets at a location along said path of travel downstream from said first-mentioned location and upstream from said collection station;

and selector switch means usable by a press operator for enabling operation of either one or both of said heating means and said spraying means.

2. Apparatus as in claim 1, and further including control means for detecting changes in the speed of operation of said press, and for effecting compensating changes in the operation of said heating means and said spraying means.

3. Apparatus as in claim 2, wherein said control means effects decrease of the radiant energy output of said heating means in response to decrease in the speed of said press, and increase in the radiant heat output of said heating means in response to increase in the press speed.

4. Apparatus as in claim 3, wherein said spraying means operates in intermittent cycles, and wherein said control means increases the duration of said cycles in response to decreases in the speed of said press, and decreases the duration of said cycles in response to increases in the speed of said press.

5. Apparatus as in claim 1, and further including a support assembly mounted upon said frame of said press upstream of and distal from said collection station, said heating means and said spraying means respectively having heat radiating and powder spraying members mounted by said support assembly.

6. Apparatus as in claim 5, wherein said support assembly includes an outer housing supporting said powder spraying members and having an open side confronting said path of travel, and an inner housing mounted within said outer housing and forming part of said heating means.

7. Apparatus as in claim 6, wherein said inner and outer housing are spaced from each other and have confronting walls defining passageways for circulation of air therebetween.

8. Apparatus as in claim 5, including photoelectric sensor means carried by said support assembly for detecting the presence of said sheets at a location along said path of travel adjacent said support assembly.

9. Apparatus as in claim 8, and further including heat shield means mounted upon said assembly between said sensor means and the path of travel of said sheets, said shield means having a viewing aperture, and means for directing compressed air into said aperture.

10. Apparatus as in claim 9, and further including a pivotally movable shield member pivotally movable to a position wherein said shield member overlies said support assembly.

11. Apparatus as in claim 5, wherein said heating means includes an elongate housing forming part of said support assembly and having an arcuate wall defining a concave surface facing said path of sheet travel, said housing having a chamber therein adjacent said wall, an infrared heating element mounted in spaced adjacent relationship to said concave surface of said wall, said concave surface reflecting infrared energy emitted by said infrared heating element toward said path of sheet travel.

12. Apparatus as in claim 11, including means for supplying compressed air to said chamber within said housing, and wherein said arcuate wall has ports therein for discharging said compressed air from said chamber through said ports and toward said infrared heating element and toward the path of travel of said sheets passing thereunder so as to direct heat away from said infrared heating element and said housing, and so as to reduce the possibility of said sheets engaging said housing.

13. Apparatus as in claim 1, and further including a photoelectric sensor for detecting the presence of a stationary one of said sheets adjacent said radiant heating means.

14. In combination with a printing press having a frame, sheet delivery means carried by said frame for conducting freshly printed sheets along a path of travel from a printing station to a sheet collection station, and anti-offset means for preventing ink offset between the sheets during collection thereof; the improvement in said anti-offset means comprising:

radiant heating means for, during operation thereof, directing radiant heat energy onto freshly printed surfaces of the sheets at a location along said path of travel spaced in an upstream direction from said collection station;

sheet spraying means disposed closely adjacent said radiant heating means for, during operation thereof, spraying anti-offset material upon the sheets at a location along said path of travel downstream from said first-mentioned location and upstream from said collection station;

and control means for detecting changes in the speed of operation of said press, and for automatically effecting compensating changes in the operation of said heating means and said spraying means.

15. Apparatus as in claim 14, wherein said control means effects decrease of the radiant energy output of said heating means in response to decrease in the speed of said press, and increase in the radiant heat output of said heating means in response to increase in the press speed.

16. Apparatus as in claim 15, wherein said spraying means operates in intermittent cycles, and wherein said control means increases the duration of said cycles in response to decreases in the speed of said press, and decreases the duration of said cycles in response to increases in the speed of said press.

17. Apparatus as in claim 14, and further including a photoelectric sensor for detecting the presence of a stationary one of said sheets adjacent said radiant heating means.

18. In combination with a printing press having a frame, a printing station and a sheet delivery station carried by said frame, sheet delivery means carried by said frame for conducting freshly printed sheets along a path of travel from said printing station to said sheet collection station, and anti-offset means for preventing ink offset between the sheets during collection thereof, the improvement in said anti-offset means comprising:

an elongate support assembly mounted upon said frame adjacent said printing station and said path of travel and distal from said collection station;

at least one radiant heating member carried by said support assembly for, during operation thereof, and directing radiant heat energy onto freshly printed surfaces of the sheets conducted along said path of travel;

a sheet spraying member carried by said support assembly for, during operation thereof, spraying anti-offset material upon the sheets at a location along said path of travel upstream from said collection station and downstream from the location whereat said radiant heating member directs radiant heat onto the sheets;

and selector switch means usable by a press operator for enabling operation of either one or both of said heating member and said sheet spraying member.

19. Apparatus as in claim 18, and further including indicator means upon said housing for visually indicating when said sheet spraying member is spraying anti-offset material, and wherein said support assembly includes an inner housing member and an outer housng member disposed in nested relationship, said radiant heating member being carried by one of said housing members and said spraying member being carried by the other of said housing members.

20. Apparatus as in claim 18, and further including a photoelectric sensor upon said support assembly for detecting the presence of a stationary one of the sheets adjacent said radiant heating member.

* * * * *